US006247472B1

(12) United States Patent
Moseley

(10) Patent No.: US 6,247,472 B1
(45) Date of Patent: Jun. 19, 2001

(54) METHOD AND APPARATUS FOR USING READILY AVAILABLE HEAT TO COMPRESS AIR FOR SUPPLY TO A COLLAPSIBLE AND PORTABLE HYPERBARIC CHAMBER

(76) Inventor: Thomas Stillman Moseley, 2501 Briggs Cheney Rd., Silver Spring, MD (US) 20905

( * ) Notice: Subject to any disclaimer, the term of this patent is extended or adjusted under 35 U.S.C. 154(b) by 0 days.

(21) Appl. No.: 09/263,076

(22) Filed: Mar. 8, 1999

Related U.S. Application Data

(63) Continuation-in-part of application No. 08/905,156, filed on Aug. 1, 1997, now abandoned.
(60) Provisional application No. 60/023,105, filed on Aug. 2, 1996.

(51) Int. Cl.[7] ..... A61G 10/00
(52) U.S. Cl. ..... 128/205.26; 128/205.24; 128/204.18; 600/21
(58) Field of Search ..... 128/202.12, 205.26, 128/200.24, 204.18; 600/21, 22

(56) References Cited

U.S. PATENT DOCUMENTS

| | | |
|---|---|---|
| 3,375,759 | 4/1968 | Smith . |
| 3,391,644 | 7/1968 | Taplin . |
| 4,974,829 | 12/1990 | Gamon et al. . |
| 5,109,837 | 5/1992 | Gamon . |
| 5,255,711 | 10/1993 | Reeds . |
| 5,275,014 | 1/1994 | Solomon . |

OTHER PUBLICATIONS

Bellofram Rolling Diaphragm Seal Advantages—www.belofram.com/advantages.htm May 27, 1997 (Text only) noted Feb. 6, 1999 AirConditioning and Refrigeration—Burgess H Jennings and Samuel R Lewis 1950 Int'l Textbook Co, Scranton Pa pp. 85–87.

Principles of Air Conditioning V Paul Lang 5th Edition Delmar Publisher 1995 pp. 143–144.

*Primary Examiner*—Dinh X. Nguyen

(57) ABSTRACT

Method and Apparatus for compressing ambient air to a pressure above ambient, directing the compressed air into a portable hyperbaric chamber in which a exothermal chemical reactor is located whereby the air is heated and changed in chemical composition and passing the heated product gas through an expansion motor wherein the work output of the expansion motor is used to help drive the compressor. The exothermal chemical reactor may support combustion or be a person.

15 Claims, 5 Drawing Sheets

METHOD AND APPARATUS FOR USING READILY AVAILABLE HEAT TO COMPRESS AIR FOR SUPPLY TO A COLLAPSIBLE AND PORTABLE HYPERBARIC CHAMBER

CROSS REFERENCE TO RELATED APPLICATIONS

This Application is a Continuation in Part of application Ser. No. 08/905,156 filed Aug. 1, 1997, now abandoned which is incorporated by reference which Application was a Continuation in Part of Provisional Patent Application Ser. No. 60/023,105 filed Aug. 2, 1996.

BACKGROUND OF THE INVENTION

Several underlying principles are key to an understanding of the present invention.

It is theoretically possible to pump a volume of fluid such as ambient air into a chamber containing fluid at a second pressure such as a compressed gas chamber with the investment of a certain amount of work which work will be exactly equal to the amount of work which is produced by taking the same volume of fluid and reversing the process, that is, expanding that same quantity of gas from the second pressure to the first pressure.

As is known from thermodynamics, adding heat to the gas such as while it is in the pressurized chamber will produce an increment of increased work during the expansion with the amount of work produced during the expansion being a function of the amount of heat added, the pressure ratio, etc. The difference between the expansion work and the compression work may be used to overcome friction and provide a net work output if desired (expansion work less compression work less friction work). The friction work is the friction force times the distance moved by a mass experiencing that friction force.

From thermodynamics, greater compression ratios and greater heating of the compressed gas lead to better engines measured with respect to work output per unit fuel used, work output per unit weight, work output per unit volume occupied by the engine, etc. Thus, there has been no motivation to make a collapsible engine and more particularly, an engine wherein the heater for the compressed gas comprises a large flaccid walled airtight container.

Rolling diaphragm pumps and expansion motors can be almost frictionless with the friction on the order of 1% of the energy needed to compress a quantity of gas.

The embodiments disclosed herein which are heat engines are most closely related to the Brayton cycle which is more commonly embodied as a gas turbine engine.

The maintenance of life requires certain supplies and conditions such as oxygen, water, food and an acceptable environmental temperature. As is obvious, such supplies and conditions need not be available except locally such as oxygen in air provided to a SCUBA diver for respiration through his mouthpiece or a suitable temperature maintained next to his skin such as may be obtained by the use of a "wet suit".

Mountain climbers climb mountains which are far from sources of resupply so that they must carry supplies with them, such supplies including food, fuel and, during high altitude climbs, bottled oxygen.

The following table suggests the atmospheric pressures (PSIA-lbf/in$^2$ Absolute) and water boiling points (temperatures) which might be expected at various altitudes:

| Pressure (PSIA) | Altitude (ft) | Water B.P. (° F.) | Pressure (PSIA) | Altitude (ft) | Water B.P. (° F.) |
|---|---|---|---|---|---|
| 4.5 | 29,000 | 157.8 | 5.0 | 26,421 | 162.2 |
| 5.5 | 24,085 | 166.3 | 6.0 | 21,951 | 170.1 |
| 6.5 | 19,989 | 173.6 | 7.0 | 18,173 | 176.9 |
| 7.5 | 16,481 | 179.9 | 8.0 | 14,898 | 182.9 |
| 8.5 | 13,412 | 185.6 | 9.0 | 12,012 | 188.3 |
| 9.5 | 10,686 | 190.9 | 10.0 | 9,428 | 193.2 |
| 10.5 | 8,232 | 195.2 | 11.0 | 7,092 | |
| 11.5 | 6,001 | | 12.0 | 4,598 | |
| 12.5 | 3,958 | | 13.5 | 2,071 | |

(Note that daily weather conditions will provide some variation of these values.)

Respiration at High Altitude

With respect to respiration, the low pressure effects of living at high altitudes slow the thought processes, make a person more susceptible to frostbite, make sleep more difficult or impossible, interfere with digestion, bring on dehydration, headaches, fluid accumulation in the lungs, etc. These effects among others are collectively identified as being symptoms of "mountain sickness".

Mountain sickness is a danger to persons living at high altitudes and can incapacitate or kill a person. Rarely, death can occur at altitudes as low as 5,000 feet above sea level. However, placing a person suffering from mountain sickness under increased air pressure for only a few hours will typically bring complete recovery.

Bottled oxygen is commonly used by mountain climbers climbing the higher peaks to increase the partial pressure of oxygen to counter the debilitation associated with high altitude and the ambient low partial pressure of oxygen but the bottle and oxygen represent heavy consumables. The gradual decline in physical ability which generally occurs as oxygen supplies are husbanded may tempt mountain climbers to make a precipitous "dash" for the peak before the bottled oxygen and physical reserves of strength and health are depleted even if conditions such as weather are marginal.

Portable hyperbaric apparatus has been available for several years for use by mountain climbers. Typically, the apparatus comprises a foot operated compressor and a flexible walled collapsible bag having a sealable opening through which a person may enter the bag. In use, a person suffering from mountain sickness enters the bag, the opening is sealed and a second mountain climber on the outside of the bag then operates the compressor whereby air is forced into the bag thereby introducing pressurized air into the bag which air is available for respiration by the bag's occupant. The pumped air inflates the bag and provides fresh air under pressure in the bag.

These bags are typically pressurized to 2 PSI above ambient. In these known portable hyperbaric bags or chambers which are now being used by mountain climbers, a pressure relief valve is used to vent air to the atmosphere. The work required to pressurize a bag is significant and stresses the climber who is manning the compressor. Thus, this apparatus is used only when a climber is ill and the apparatus is otherwise a dead weight for the mountain climbers to carry up and down a mountain. However, it is a needed dead weight since it may be absolutely necessary in an emergency.

Patents demonstrating the known prior art relating to portable hyperbaric apparatus such as is used by mountain climbers include: U.S. Pat. No. 4,974,829 to Gamow et al and U.S. Pat. No. 5,109,837 to Gamow.

The above table shows that a person in a portable hyperbaric pressure chamber at 29,000 ft altitude at 2 PSIA above ambient pressure would experience a pressure as if he were exposed to the ambient pressure at just under 20,000 ft. At about 24,100 ft in a chamber at 2 PSIA above ambient, a person would be at a pressure equivalent to the ambient pressure at about 16,500 ft altitude. A person at about 22,000 ft altitude would experience a pressure roughly equal to 14,300 ft which is about equal to the altitude of the base camp used for most climbs on Mt. Everest.

It would be desirable to allow a mountain climber to rest and/or sleep in a pressurized space using little or no effort on the part of the mountain climber or his fellows.

It would thus become possible to wait out a storm at relatively little and possibly no cost in bottled oxygen while maintaining physical strength and reserves. Mountain climbing would become safer since a dash for the top could be delayed until conditions are optimal. This delay would cost only time and only a slight decline in physical strength, health and supplies. Indeed, the physical strength and health of a climber could actually increase through rest during such a delay under many conditions.

Cooking under Pressurized Air

During mountain climbs, water is typically available from ice and snow on the mountain but must be melted at a cost in the fuel used to heat and melt the snow and/or ice. Hot prepared food is both nutritious and provides warmth and psychological benefits.

The fuel needed for a fire is often unavailable from the environment at higher altitudes such as above the "tree line", and must be carried by the climber. Low ambient pressure and temperature both increase the amount of time and fuel needed for cooking since the boiling temperature of water (which sets the maximum temperature for many cooking processes) decreases with decreased ambient pressure as indicated in the above table.

Pressure cookers are known in art. In using such cookers, food and water is placed in the cooker which is then sealed and heated until the water is boiling whereupon the superatmospheric pressure generated within the cooker by the evolved steam raises the boiling temperature of the water and thus the cooking temperature so that the cooking time is decreased.

The cooking times for foods increase with increasing altitude and in a non-linear manner. Cooking instructions such as for cake mixes commonly provide for increased cooking temperatures or cooking times at higher altitudes. Three minutes is the approximate time needed to hard boil a chicken egg in boiling water at sea level. However, water boils at about 102° F. at about 65,300 ft altitude so that an egg in boiling water at this altitude is no warmer than when being brooded by a hen which obviously does not hard boil the egg. The quantity of fuel needed for cooking increases with cooking time.

The use of a flame to provide heat for cooking and melting snow and ice becomes increasingly difficult as the partial pressure of oxygen available decreases.

It would be desirable for mountain climbers to be able to melt snow or ice or cook wherein both the heating flame and the material being heated are under increased pressure relative to the ambient. Again, the maintenance of the increased pressure would be desirably at little or no additional cost in effort or supplies beyond those needed for the cooking or melting process itself.

Compressors and Rolling Diaphragm Devices

As is known, positive displacement fluid pumps have two distinct portions of the stroke. In particular, the fluid is increased in pressure from the fluid supply pressure to the pressure of the receiver into which the fluid is pumped during the first part of the stroke: During this portion of the stroke, the force needed to continue the stroke of the piston gradually increases. The subsequent portion of the stroke does not increase the pressure of the fluid but only expels the fluid into the receiver: During this portion of the stroke, the force needed to continue the stroke of the piston (assuming constant piston area) is generally considered to be constant.

If the fluid is incompressible, the pressurization portion of the stroke is of negligible length and essentially all of the stroke serves to expel the fluid from the pump chamber.

If the fluid is compressible, then the two portions of the stroke are distinct. As the pressure difference generated by the pump is increased, the length of the second portion of the stroke, that is, the expulsion portion of the stroke, gradually becomes less and less of the total stroke.

Rolling diaphragm devices are known in the prior art. The characteristics of these devices typically limit operation to only a relatively few strokes per minute (up to perhaps several hundred strokes per minute) but rolling diaphragm devices can be very low in friction and operate essentially without leakage. Marsh Bellofram Corporation of Newell, W.V. as of Feb. 6, 1999 maintained a web page describing rolling diaphragms. In this web page on this date, Bellofram Corporation claimed that their "rolling diaphragms can respond instantly to pressure changes as slight as 0.1 inches (0.003 psi) of water." (www.belofram.com/advantages.htm)

A sample calculation is illustrative. If a rolling diaphragm device of 3 inch diameter and 2 inch stroke is used to compress air (standard atmosphere) from 14.69 PSIA at 60° F. (standard atmosphere) to 16.69 PSIA, about 2.28 ft-lbf of work is needed ($0.00238\ \text{slug/ft}^3 \times 32.174\ \text{lbm/slug} \times 2 \times 3.14159 \times 32/4\ \text{in}^3 \times ((16.69/14.69)^a 1) \times (460+60)\text{OR} \times 0.238\ \text{BTU/(lb}_m\ {}_o\text{R} \times (1/12\ \text{ft/in})^3$ wherein $a=(k-1)/k$ and $k=1.40158$). This pressurization takes place over the first 0.1736 inches of piston stroke and the additional work needed for expelling the air from the cylinder is 2.152 ft-lbf ($(2-0.1736)\ \text{in} \times 3.14159 \times 3^2/4\ \text{in}^2 \times (16.69-14.69)$ PSIA= 25.82 in-lbf) for a total needed energy of 4.43 ft-lbf.

If a friction force of 0.01 PSIA must be overcome, the energy lost to friction is 0.283 in-lbf ($2\ \text{in/stroke} \times 3.14159 \times 3^2/4\ \text{in}^2 \times 0.01\ \text{lbf/in}^2 \times 2$ stroke/cycle) or 0.0236 ft-lbf or 0.533% of the compression work. The Marsh Bellofram web page suggests that the friction may be as little as a third of 0.01 PSI so that the friction work might be as little as about 0.18% of the compressor work. This represents the energy loss per diaphragm used. If a complete motor/compressor such as will be described hereinbelow uses two diaphragms, then the energy loss due to diaphragm friction will be twice the above calculated value or 0.0472 ft-lbf or 1.066% of the compression work. (Calculations performed herein show more places of accuracy than is likely to be obtained in any experiment but are shown to allow reconstruction of the equations and constants used to obtain the calculated numbers.)

Patents illustrating the known prior art relating to rolling diaphragm devices include: U.S. Pat. No. 3,375,759 to Smith, U.S. Pat. No. 3,391,644 to Taplin, U.S. Pat. No. 5,255,711 to Reeds and U.S. Pat. No. 5,275,014 to Solomon.

(The prior art system as represented by U.S. Pat. No. 4,974,829 to Gamow et al and U.S. Pat. No. 5,109,837 to Gamow is in certain ways analogous to apparatus for lifting a succession of weights which are allowed to fall to the ground after being lifted such that the energy invested in lifting each weight is lost. This is in contrast to lifting each weight by means of a child's teeter totter wherein the energy obtained in the lowering of one weight is used to partially offset the energy needed to lift the succeeding weight. In this analogy, each weight represents a quantity of gas which is compressed and introduced into a portable hyperbaric chamber while the energy used to "lift" the quantity of air is the energy needed to compress that quantity of air to the desired pressure. It will be seen that the energy requirement wherein the weight is dropped onto the ground includes both friction and the energy needed to lift the weight while, in the second case, the required energy is only that needed to overcome any friction in the teeter totter.)

BRIEF SUMMARY OF THE INVENTION

It is a first object of the present invention to provide a portable collapsible hyperbaric chamber containing an exothermic chemical reaction heat generator, an expansion motor and a compressor which compressor is driven by the expansion motor to compress air which is introduced into the chamber at an increased pressure to improve the function of the heat generator, the air being heated in the chamber by the heat generator and the heated air passing through the expansion motor wherein a portion of the heat energy produced by the heat generator is used to drive the expansion motor and the compressor.

It is another object of the present invention for said heat generator to be a living being such as a mountain climber whereby the heat generated by the living being is due to the metabolism of food which serves as fuel for the heat generator where the normal heat rejection processes of the living being effect transfer heat energy from the living being to the air in the chamber. Such heat energy transfer may be by heat exchange of air which enters the climber's lungs and/or heat exchange between the air and the climber's skin.

It is another object of the present invention to provide survival apparatus for use by a mountain climber which employs rolling diaphragm devices to perform compressor and expansion motor functions such that the metabolic heat generated by the mountain climber supplies at least part of the power needed to drive the apparatus which apparatus provides compressed air for ventilation and respiration by the mountain climber.

It is yet another object of the present invention to provide a heat engine comprising a reciprocation motion compressor, a chamber containing a source of heat and a reciprocating motion expansion motor wherein the source of heat is the metabolic heat of a person living within the chamber. The heat engine thus provides a compressed air chamber in which a person may live under a pressure above ambient and may be used to treat a person suffering from mountain sickness or other effects of low pressure/high altitude. Rolling diaphragm "pistons" are used in the motor and compressor.

Yet another object is to provide a portable hyperbaric chamber which may be pressurized by means of a compressor and expansion motor wherein the chamber may contain an oxidizing exothermic reaction such as combustion and a container for effecting a thermally induced change in a material within said container wherein the compressor and expansion motor are driven by a portion of the heat energy produced by the exothermic reaction.

Still another object to provide a portable hyperbaric chamber which may be pressurized by means of a compressor and expansion motor wherein the chamber may contain a combustion flame and a container for cooking food placed therein and/or melting snow and/or ice wherein the compressor and expansion motor are driven by a portion of the heat energy produced by the combustion flame.

Yet another object is to make a heat engine using a flaccid walled heater for the compressed gas used in the cycle.

Still another object of the present invention is to provide a heat engine using a multistage compressor with interstage cooling.

Yet other objects will be clear upon reading the following.

DETAILED DESCRIPTION OF THE INVENTION

In the various figures, elements having similar functions are assigned the same identifying numbers. Where the functions differ sufficiently or particular feature details need to be identified, additional numbers are assigned as appropriate. A listing of the elements and their identifying numbers appears in the Specification immediately before the claims.

While rolling diaphragms are available on the market, the Applicant has made diaphragms according to his particular needs (e.g., unusual shapes) of RTV (Room Temperature Vulcanizing) silicon rubber (such as Silicone II Window & Door Sealant produced by General Electric Company, Waterford, N.Y. 12188 (tube references U.S. Pat. Nos. 4417042 and 4483973) spread over a suitable form such as of paraffin or waxed paper to yield a flexible sheet which may be cut as desired and bonded along seams using RTV rubber. Reenforcing material such a directionally laid threads or fine cloth (such as ersatz silk scarf material) may be incorporated into the sheet before it cures to provide controlled stretch characteristics for the final sheet.

The Applicant believes that a person having ordinary skill in the art will be able to construct apparatus according to the instant invention using teachings found herein and in the published literature without undue experimentation.

Figure 1:
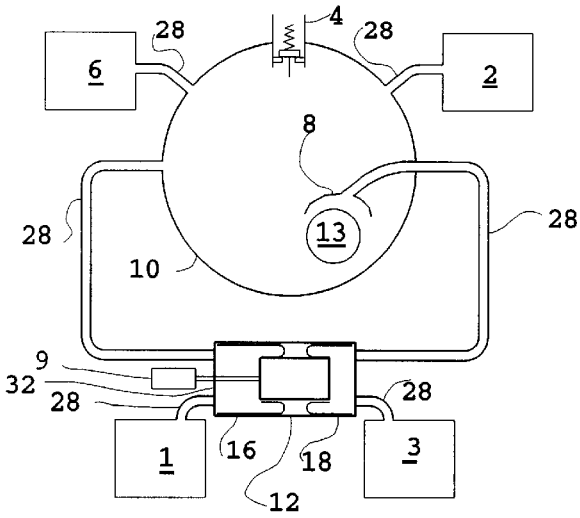
FIG. 1 schematically shows one arrangement of basic elements which may be used with apparatus embodying the instant invention.

FIG. 1 schematically shows a hyperbaric chamber 10, expansion motor/compressor 12 comprised of compressor 16 and expansion motor 18, a heat source 13, a compressed gas source 2, a pressure relief valve 4 and a second expansion motor 6. 10 is a hyperbaric chamber such as but not limited to a Gamow bag as disclosed in U.S. Pat. No. 4,974,829 to Gamow et al and U.S. Pat. No. 5,109,837 to Gamow. The hyperbaric chamber 10 may be sausage shaped like the known commercially available portable hyperbaric chambers or spherically shaped to efficiently contain a small fire in a small camp stove or cooking heater as described hereinbelow.

The wall material of the hyperbaric chamber 10 is preferably flaccid so that the chamber may be deflated and folded into a compact portable package. While it desired that the wall material of the chamber 10 be flaccid, it is preferable that the wall material not stretch significantly when stressed so that the volume contained within an inflated chamber 10 is relatively unaffected by variations in the pressure of the inflating gas.

FIG. 1 also shows tubes or pipes 28 which are provided to allow passage of gas from a gas supply or source 1 to the compressor intake, conduct compressed gas from the compressor exhaust to the enclosure or hyperbaric chamber 10, from the hyperbaric chamber 10 to the expansion motor intake and from the expansion motor exhaust to a gas sink or receiver 3. Tubes 28 are also provided to conduct gas from the compressed gas source 2 to the hyperbaric chamber 10 and from the hyperbaric chamber 10 5 to the second expansion motor 6.

A drive means 9 may assist the expansion motor/compressor 12 at such times as the power produced by the expansion motor 18 is insufficient to drive the compressor 16. The drive means 9 may be as simple as a rod extending through either end cap (such as end cap 32 as shown) which allows manual longitudinal drive of the spindle 22 or connection to an actuator such as a pneumatic or electric or other motor.

The gas normally comprises oxygen mixed with other gases and generally of a composition such that it would be commonly considered to be air. However, the gas flowing to the expansion motors 6 and 16 may be air enriched with products due to respiration or combustion as will be apparent from the following disclosure. The compressed gas source 2 may provide compressed air, compressed oxygen or a mixture of these two gases. The gas compositions appearing in the various elements should not be considered to be limited to those discussed herein above.

Figure 2:
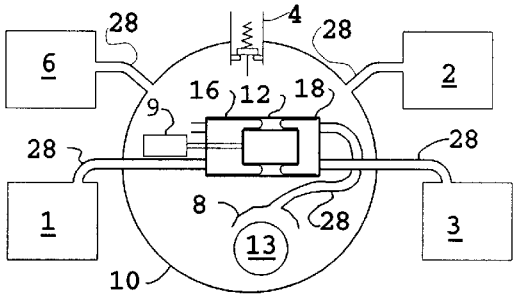
FIG. 2 schematically shows a second arrangement of elements which may be used with apparatus embodying the instant invention.

Looking at FIG. 1, it will be seen that the expansion motor/compressor 12 is located outside of the hyperbaric chamber 10. FIG. 2 shows an alternate arrangement wherein the expansion motor/compressor 12 is located within the hyperbaric chamber 10. The compressed gas source 2 and/or the second expansion motor 6 may be located within the hyperbaric chamber 10 if desired.

Pressure relief valve 4 is provided as a safety device. Further, if the valve may be manually overridden, the valve may be used to depressurize the hyperbaric chamber 10 by manually opening the valve to allow the escape of pressurized gas from the chamber to the surrounding low pressure ambient.

Gas collector 8 is conveniently an extension of the specific tube 28 which conducts gas from the hyperbaric chamber to the intake valve of the expansion motor 18 and may be used to collect heated air from the space immediately near heat source 13 within the hyperbaric chamber 10. By this stratagem, the gas after heating will not reside in the hyperbaric chamber 10 during which time it may loose heat but go directly to the expansion motor 18 thus retaining maximum enthalpy.

The gas collector 8 could be a mask placed over the face of a person 14 if a person is serving as the heater or a collector or hood if the heater is a flame 15 in a camping stove or the like.

Figure 3:
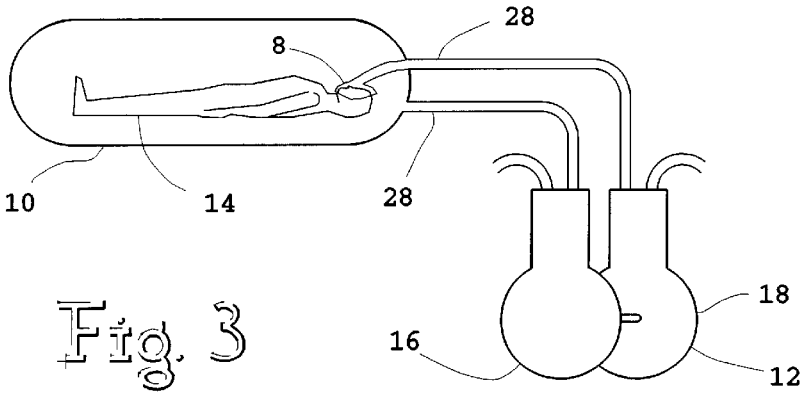
FIG. 3 schematically shows an arrangement of selected elements of the instant invention.

FIG. 3 is a schematic outline of the a hyperbaric chamber compression system with the various elements shown and numbered.

Looking at FIG. 3, 10 is a portable hyperbaric chamber which is conveniently in the form of a flexible wall bag having an opening by which a person may enter the hyperbaric chamber after which the opening may be sealed and air in the hyperbaric chamber pressurized. Such hyperbaric chambers are known and have been called "Gamow" bags. Details of the bag's construction are not necessary to an understanding of the present invention and will be found in Patents referenced elsewhere as issued to Gamow.

12 is an expansion motor/compressor which is comprised of an expansion motor 18 and a compressor 16 which expansion motor/compressor draws air from the ambient, compresses the air in the compressor portion of 12, passes the compressed air to hyperbaric chamber 10 and receives compressed air from the hyperbaric chamber 10 and expands the air in the expansion motor portion of the motor/compressor 12. Work produced by the expansion of the gas in the expansion motor 18 of the motor/compressor of 12 is used to provide work to effect the compression of air by the compressor 16 which is part of the motor/compressor 12.

Appropriate tubes 28 are used to carry compressed gas from the exhaust valve 42 of the compressor 16 to the hyperbaric chamber 10 and from the hyperbaric chamber 10 to the intake valve 44 of the expansion motor 18.

In FIG. 3, living creature 14 in the hyperbaric chamber 10 produces heat while changing the composition of the gas as it passes through the chamber 10. Some of the oxygen in the compressed air entering the hyperbaric chamber 10 will be chemically combined with carbon from food to make carbon dioxide which gradually will foul the air in the chamber 10 if it is not removed and replaced with fresh air. Typically, about 1.7 $ft^3$/minute is needed in providing fresh compressed air for use by a person in a Gamow bag.

An estimate of the heat and work energies involved is instructive. The ambient air at high altitudes where mountain sickness of concern is typically below 32 degrees F. as evidenced by snow cover and temperatures may be very significantly lower.

For purposes of illustration, assume that the temperature of a gas stream heated by a person is about 60 degrees Fahrenheit (significantly less than a person's body temperature of 98.6 degrees Fahrenheit).

For these conservative temperature values, (32 F° and 60 F°), Carnot efficiency Ec is:

$$Ec=1-(459.73+32)/(459.73+60)=\text{about } 5\%$$

An extremely low friction compressor and expansion motor is needed to make use of the low grade heat represented by the heat released by a living creature such as a person or a camp stove operated to produce minimal wasted heat and thus use minimal fuel.

In principle, nearly any compressor/motor of positive displacement type might be used but the practical problems of friction set severe constraints which are not easily met. The valve actuation schedule of such motors and compressors are believed to be well known and determined by the motor and compressor selected.

Rolling diaphragm compressors and expansion positive displacement devices can be used to make the desired motor compressor 12. These devices can have extremely low friction.

Assuming a basal (survival level) metabolic rate of a person is 1200 Calories/day, this person produces 4762 BTUs/day equaling 0.05511 BTUs/sec or 42.88 ft lbf/sec of heat. At 5% efficiency, the work available to overcome friction is 5%×42.88 ft lbf/sec 2.2 ft lbf/sec. (This value is approximate since the ambient temperature, the heating temperature and the heating rate are all approximate.)

This work is available to overcome friction and other losses in the motor/compressor and to drive the second expansion motor 8 which may be used to provide work for other purposes such as to operate the various valves and/or power the drive means 9.

Roughly 1.7 $ft^3$/min of air is required for respiration by a person in a Gamow bag. Using a piston having a 2 inch stroke and 3 inch diameter, about 3.5 strokes per second are needed. Thus, 2.2 ft lbf/sec is 0.6286 ft-lbf/stroke (one work stroke per cycle) which is available to overcome the power lost to friction which is 0.0236 ft-lbf per stroke per diaphragm. This estimate suggests that, for a two diaphragm motor/compressor, about 2×4% or about 8% of the net work output is sufficient to overcome the diaphragm friction.

(Note that the diaphragm friction may be only a third of the value used in this calculation, that the food consumption and heat production rate of a mountain climber is low by a factor of more than two and that conservative temperatures for calculating the Carnot efficiency were used so that the motor should have plenty of power to drive the compressor if care is used in the actual design.)

It is possible to increase the efficiency of a rolling diaphragm motor/compressor by varying the shapes of certain elements and carefully timing the opening and closing of the valves. Principles of valve scheduling are known in the art.

There are two stages in the stroke of a positive displacement gas compressor. In the first stage, the gas is compressed and the pressure of the gas increases while the gas remains in the compression space. In the second stage, the continued stroke causes the gas to be expelled at a constant pressure to a receiver.

The compressor used in the present invention uses the major portion of the compression stroke to expel gas which was compressed in the first portion of the stroke. In most compressors, the major portion of the stroke is used to effect high compression and only a small part of the remainder of the stroke used to expel the compressed gas.

Likewise, the major portion of the expansion stroke in the expansion motor in the present invention is used to draw compressed air into the motor and only a relatively short final portion of the stroke is used to perform the expansion of the gas.

If the motor inlet valve were merely left open during the entire expansion stroke, the gas in the motor would still be under full pressure at the end of the expansion stroke and capable of performing useful work when it is vented upon opening the exhaust valve at the end of the expansion stroke. Thus, closure of the motor intake valve shortly before the end of the expansion stroke is of benefit.

The high efficiency/low friction requirements and the compression/expulsion and filling/expansion characteristics are best met by using rolling diaphragm apparatus.

Thus, the expansion motor and compressor in the motor/compressor 12 are preferably based on rolling diaphragm positive displacement devices.

Figure 4:
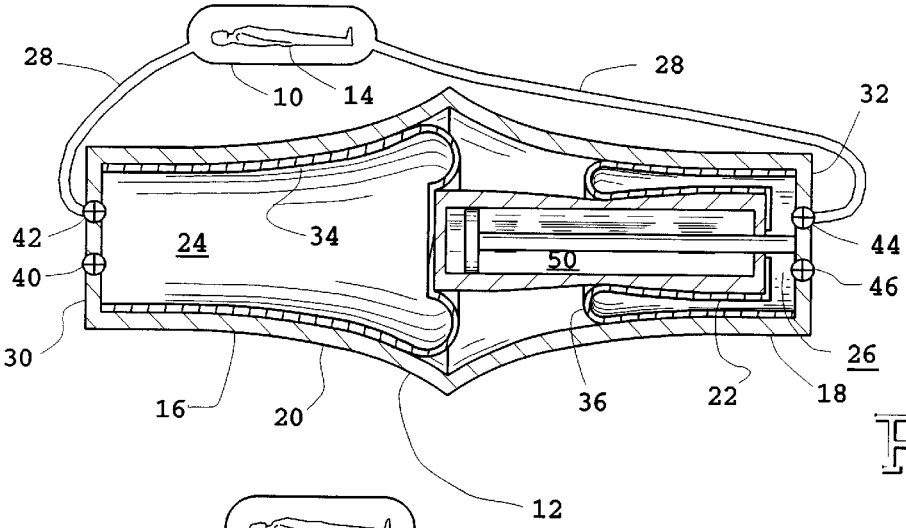
FIGS. 4 and 5 disclose various shapes of certain elements of the motor/compressor of the invention disclosed herein.
Figure 5:
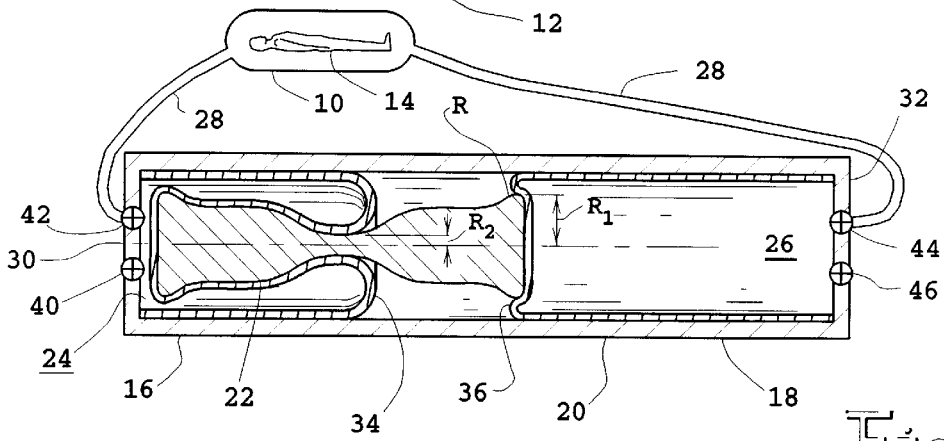

FIGS. 4 and 5 show different designs of an arrangement of the motor/compressor 12. The motor/compressor 12 comprises the compressor 16 and the expansion motor 18 which are incorporated in structure including a single containing cylinder 20 which is closed at either end by end caps 30 and 32 with the motor and compressor volumes contained between rolling diaphragms 34 and 36, the containing cylinder 20 and the end caps 30 and 32. Spindle 22 serves to couple the displacements of the compressor diaphragm and expansion motor diaphragm and to define the shape of these diaphragms.

The containing cylinder 20 and/or spindle 22 (connecting the "pistons" of the compressor and motor) may be given a variation in radius as a function of longitudinal position along these elements. This variation may be selected so that the variation in volume in the compressor displacement volume 24 (located generally between the end cap 30 and the compressor diaphragm 34 and within the containment cylinder 20) and the variation in volume in the motor displacement volume 26 (located generally between the end cap 32 and the motor diaphragm 36 and within the containment cylinder 20) as a function of displacement of the spindle 22 may be related to the gas pressure in these volumes and the pressure in the volume within 20 and between the diaphragms 34 and 36 to provide a desired force schedule as a function of longitudinal spindle location.

FIG. 4 generally illustrates the concept and shows a variation in diameter as a function of longitudinal location for both the containing cylinder 20 and the surfaces of the spindle 22.

FIG. 5 shows an embodiment wherein the diameter of the spindle increases relatively abruptly near the ends and decreases near the center of the spindle. It will be seen that the effective radius of motor "piston" represented by the rolling diaphragm 36 will increase as the diaphragm engages the radially enlarged end R (of radius R1) of the spindle at the end of the motor expansion stroke. Likewise, the effective radius of the compressor piston represented by the roiling diaphragm 34 will decrease as the diaphragm 34 engages the necked down portion (of radius $R_2$) of the spindle 22.

In both FIGS. 4 and 5, the motor intake valve 44 and motor exhaust valve 46 are opened such that the motor displacement volume 26 is open to the hyperbaric chamber 10 until near the end of the expansion stroke. At this point, it is preferred but not necessary that the expansion space be isolated by closing the motor intake valve 44 so that the gas in the expansion space may expand during the remainder of the stroke. In the embodiment of FIG. 5, the closure of valve 44 may coincide with the rolling of the diaphragm 36 onto the radial enlargement R on the spindle 22 so that, as the pressure in the motor displacement volume 26 drops on further expansion, the area on which the pressure in 26 increases tending to maintain a constant force acting through the spindle 22 on the compressor 16. The decrease in radial diameter of the spindle 22 which simultaneously allows a decrease in the effective piston area of the diaphragm 34 at such time as the last of the compressed gas is being expelled from the compress displacement volume into the hyperbaric chamber 10 means that the force (equal to decreased area times the compressor output pressure) may be decreased in this part of the stroke. A great many force schedules as a function of longitudinal position of the spindle 22 may be obtained by tailoring the surface shapes of the spindle 22 and the containing cylinder 20.

On the return stroke, the motor intake valve 44 is closed and the motor exhaust valve 46 is opened. Means such as the piston and spindle motor 50 shown in spindle 22 in FIG. 4 (with appropriate control valves, tubes for carrying the compressed motive gas and exhaust gas, etc. which are not shown), spring, air spring, etc., may be used to drive the spindle to expel expanded gas from the motor displacement volume 26 at the completion of the compression stroke to drawn fresh air into the compressor displacement space 24.

FIGS. 6*a*, 6*b*, 6*c* and 6*d* show different steps in a stroke and schematically illustrate features of interest relative to the function of rolling diaphragm devices having variations in the radius of the inner surface of a containing cylinder 20.

Considering first a compression stroke and beginning at the start of the compression stroke (FIG. 6*a*), the portion of the diaphragm 34 of the compressor "piston" farthest from the compressor end of the device is within a radially expanded region 52 such that the compression displacement volume 24 enclosed by diaphragm 34 includes a toroidal bulge 54. The motor diaphragm 36 does not have a portion extending into the radially enlarged region 52 so that first motion of the spindle toward the compressor end of the device will pull the diaphragm enclosing the toroidal bulge of the compressor displacement volume 24 into the space between interior surface of the containing cylinder 20 and the exterior surface of the spindle 22.

Figure 6A:
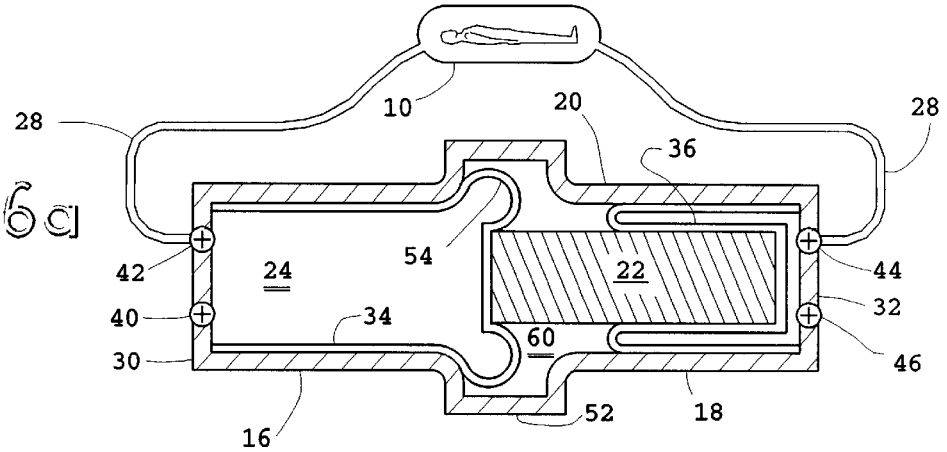
FIGS. 6*a*, 6*b*, 6*c* and 6*d* schematically show a motor/compressor according to the present invention and shows the manner of progressive rolling of the diaphragms used in the motor/compressor.
Figure 6B:
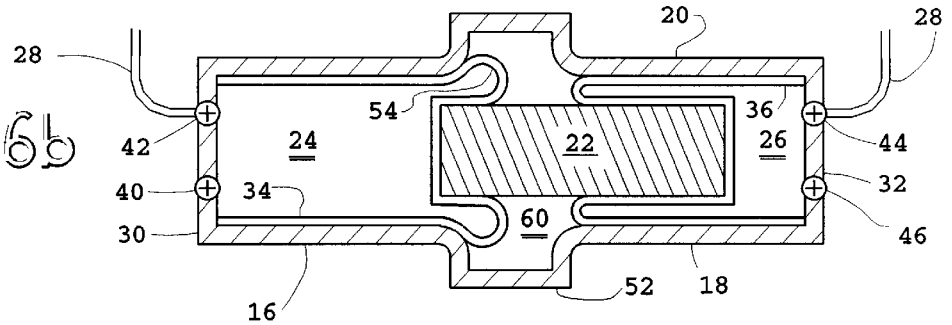

As noted above, as the spindle 22 moves from the position shown in FIG. 6*a* to the position shown in FIG. 6*b*, the compressor diaphragm 34 is pulled so that the toroidal bulge 54 of the compressor displacement volume 24 space is "swallowed" in the space between the containment cylinder 20 and the spindle 22 in the compressor end of the device. The gas in the compression space preferably undergoes compression up to approximately the chamber pressure as the toroid is swallowed. By following this design guideline, it is possible for the entire first part of the stroke represented by FIGS. 6*a* and 6*b* to require an approximately constant pressure in the expansion motor displacement volume 26.

Motion of the spindle 22 expels the already compressed gas through the compressor exhaust valve 42 into the hyperbaric chamber 10 with gas from the chamber flowing into the expansion motor 18 through motor intake valve 44 at the same time.

Figure 6C:
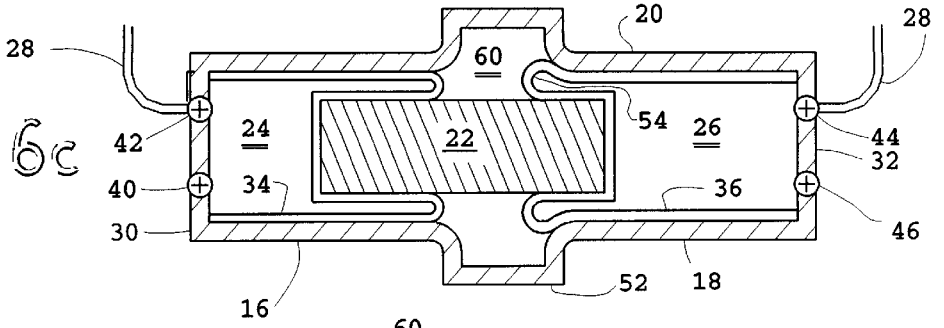

It is preferred that the expansion motor intake valve 46 be closed when the expansion diaphragm starts to form a toroidal bulge of the expansion space as shown in FIG. 6*c*. While the pressure will now drop during further expansion, creation of the toroidal bulge during continued expansion will effectively increase the "piston area" so that the decreasing pressure in the expansion chamber will still be able to drive the spindle toward the compressor end of the device to complete expulsion of the compressed gas into the receiver such as hyperbaric chamber 10.

Figure 6D:
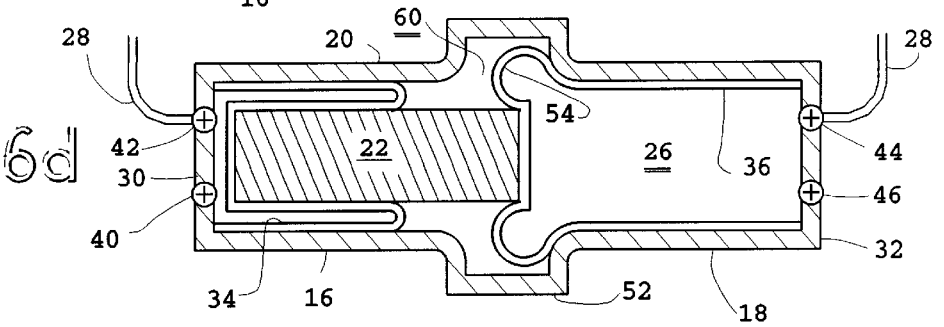

The spindle 22 continues its motion until the apparatus is as shown in FIG. 6*d* whereupon the return stroke of the spindle 22 causes the diaphragms to follow the reverse sequence from FIG. 6*c* to FIG. 6*a* albeit with the valves appropriately opened and closed to suit the return stroke. It will be noted that a toroidal bulge 54 appears in the diaphragm of the expansion motor when the elements are in the position shown in FIGS. 6*c* and 6*d*.

60 is the space inside the containing cylinder 20, exterior to the spindle 22 and between the expansion motor diaphragm 36 and the compressor diaphragm 34. As is known in the art, the diaphragms will be maintained in the proper shape if the space 60 is maintained at a pressure below the pressure in the compressor displacement volume 24 and the motor displacement volume 26.

Figure 7:
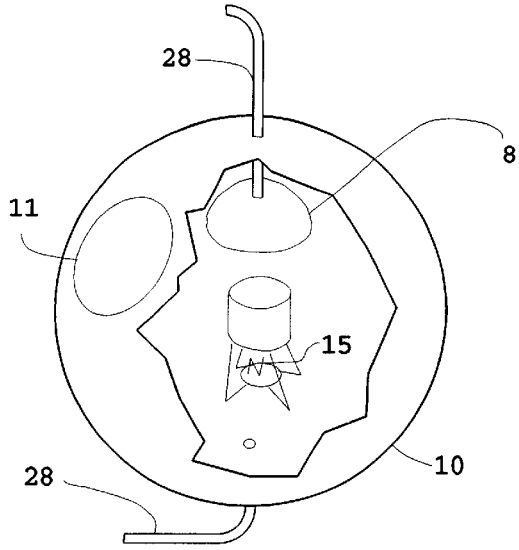
FIG. 7 shows a cut-away perspective view of a hyperbaric chamber which is to be used with a motor/compressor according to the present invention which hyperbaric chamber is particularly shaped for use in melting frozen water or cooking.

FIG. 7 discloses a hyperbaric chamber 10 used with a motor/compressor (not shown) according to the instant invention which hyperbaric chamber 10 is shaped and sized to allow cooking under a pressure above ambient while providing pressurized air for combustion by the flame 15. A motor/compressor and appropriate connecting tubes 28 are provided similar to the arrangements shown in the other Figures. So that the walls of the hyperbaric chamber 10 may best resist the contained pressurized gas, the chamber 10 may be spherical. An access porthole 11 mounted in the wall of the hyperbaric chamber 10 may be opened for access to the interior of the chamber 10 or closed and sealed.

A gas collector 8 such as a hood is shown in FIG. 7 as located above the apparatus which contains the flame 15 which apparatus may be a camp stove or the like. The gas collector 8 thus serves as a vent or chimney for the products of combustion released by the flame 15 and conducts them to the expansion motor of the motor/compressor. Details of the camp stove are unnumbered but the figure is intended to show a burner, the flame 15 and a small pot located above the burner with the gas collector 8 located above all of these items.

The hyperbaric chamber 10 in FIG. 7 may be provided with ribbing in the chamber wall to help it maintain its shape when it is unpressurized such as when the access porthole is open when the flame 15 is lighted, extinguished or adjusted or the material being heated is moved. Any suitable supports for the spherical hyperbaric chamber 10 of this FIG. 7 may be used or rocks and/or snow may be piled up to provide the desired support.

Figure 8:
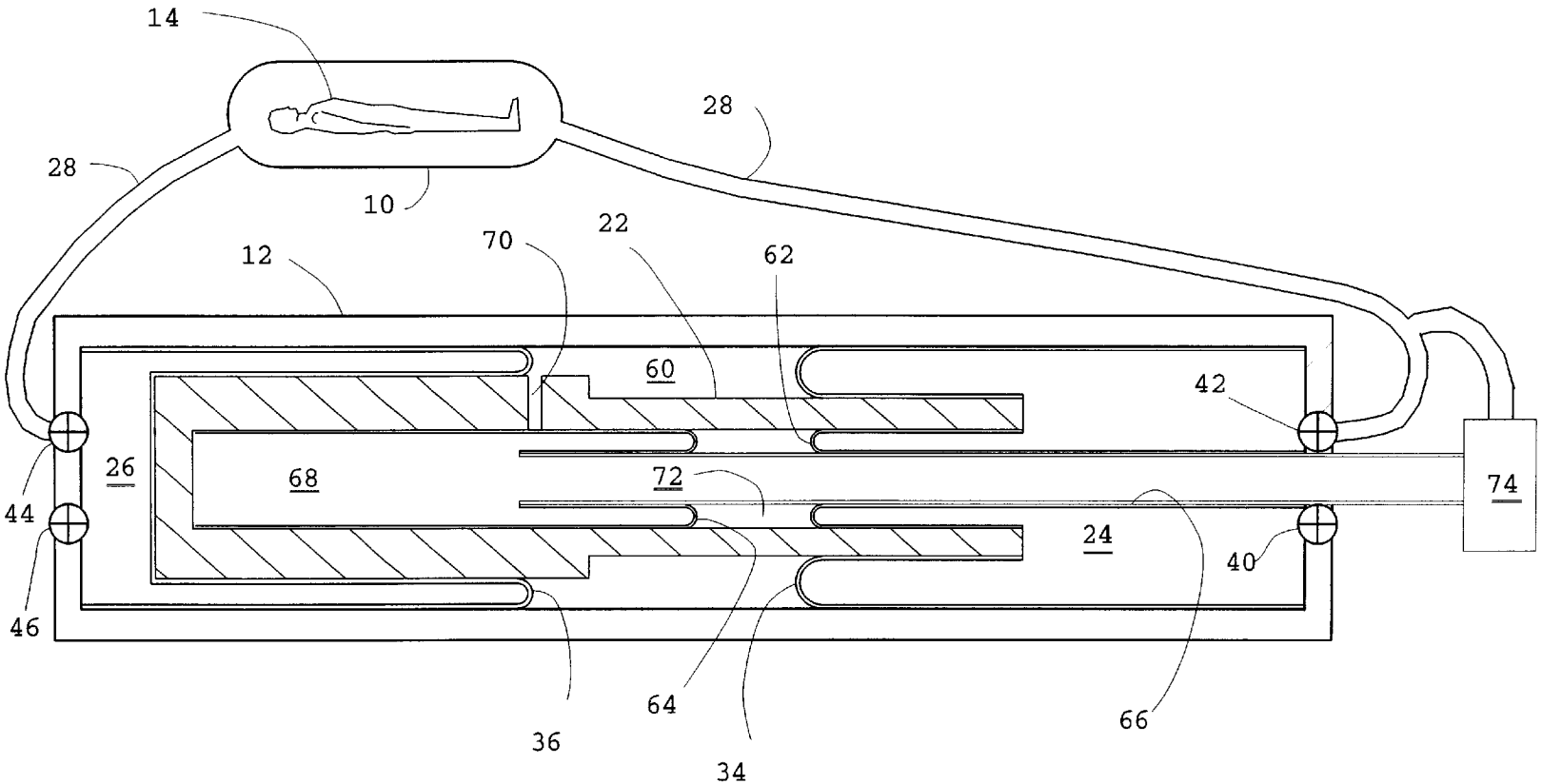
FIG. 8 shows a motor/compressor with a hyperbaric chamber wherein an air spring is used in the motor/compressor for moving the spindle during the compressor intake/motor expulsion stroke.

FIG. 8 shows an embodiment of a expansion motor/compressor 12 wherein the expansion motor end of the spindle 22 is of a greater diameter than the compressor end of the spindle 22 so that the effective areas of the expansion motor "piston" is greater than the effective area of the compressor "piston" so that the motor will be able to move the spindle 22 on a compression stroke when the compressor displacement volume 24 and the expansion motor displacement volume 26 contain gas at the same pressure such as the gas pressure in the hyperbaric chamber 10. When the pressures in these two volumes are decreased such as down to the ambient pressure, then the gas pressure acting on the effective piston area of the air spring will effect a return stroke of the spindle 22. The compressor intake and exhaust valves 40 and 42 may be check valves as is known in the compressor art while the expansion motor intake and exhaust valves 44 and 46 may be actuated such as manually or by an available work output such as by a second expansion motor (as second expansion motor 6 shown in other Figures) or by a mechanism transmitting motion appropriately from the spindle 22.

The air spring comprises air spring diaphragms 62 and 64 and tube 66 by which gas pressure is communicated into the cylindrical cavity 68 which contains the diaphragms 62 and 64. The space 72 between the diaphragms 62 and 64 should be at a low pressure so that the diaphragms will stay flexed properly. Communicating passages through the spindle 22 such as the representative communicating passage 70 may be provided so that the space 60 and space 72 will be at the same pressure.

The end of tube 66 could terminate within the compressor displacement volume 24 with the desired air spring function obtained by making tube 66 long and of two diameters. Alternately, a constant diameter tube 66 could be used with a direct fluid communication made between the space in the hyperbaric chamber 10 and the cylinder cavity 68. However, in both cases, the diameter of the diaphragms 62 and 64 and the tube 66 become small so that the length to diameter ratio of the diaphragms is great and the diaphragms do not want to roll freely.

Figure 9:
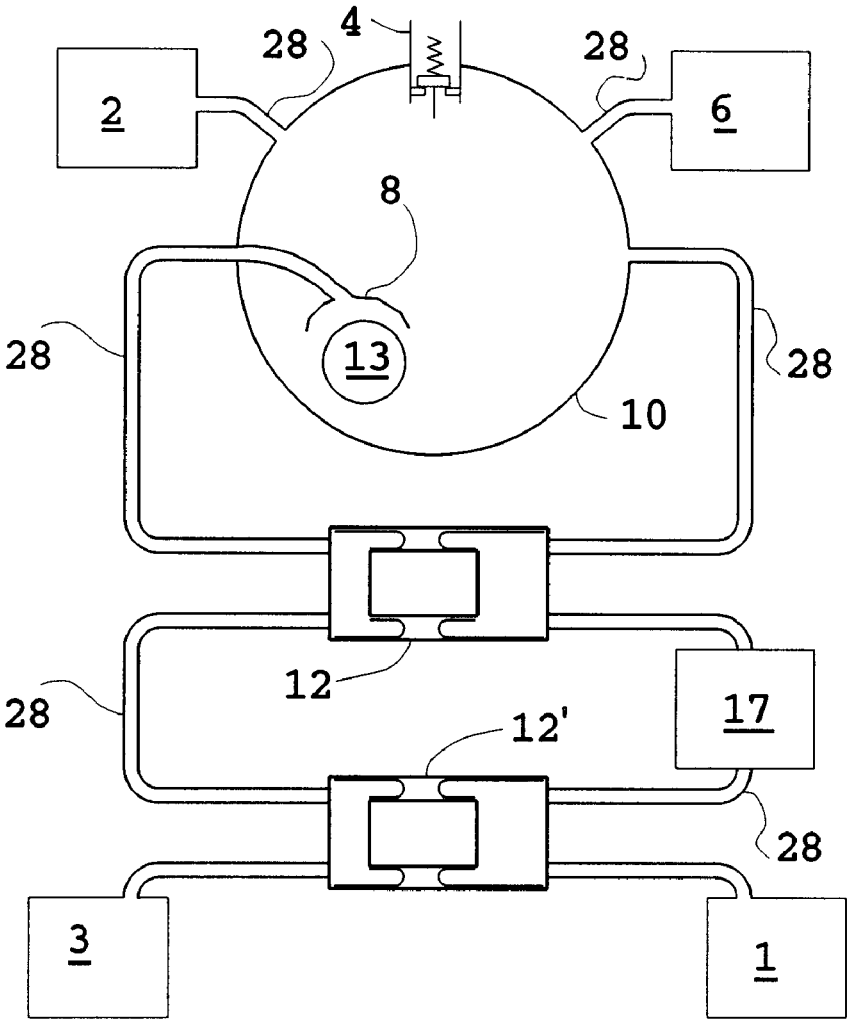
FIG. 9 schematically shows an arrangement of basic elements which may be used with apparatus embodying the instant invention and which is generally similar to the arrangement of FIG. 1 but using a multistage compressor scheme with interstage cooling.

Instead, a pressure reducer 74 may be used as shown in FIG. 9 to lower the pressure applied to the cylinder cavity 68 of the air spring thus allowing the use of larger diameter diaphragms.

FIG. 9 schematically shows expansion motor/compressor apparatus which comprises expansion/motor 12 and expansion motor/compressor 12' wherein the compressor of the expansion/motor 12' receives ambient air and compresses the air which is caused to pass through heat exchanger 17 whereby heat appearing in the compressed air due to the compression is transferred to the ambient air before the compressed air is passed to the intake of the compressor of the expansion motor/compressor 12 wherein the air is further compressed before passing to the hyperbaric chamber 10. The air leaving the hyperbaric chamber 10 passes through the expansion motors of the expansion motor/compressors 12 and 12' successively. Tubes, valves etc., are provided as needed and in accordance with teachings found hereinabove with respect to these elements. It will be seen that the arrangement of the elements in FIG. 9, apart from the heat exchanger 17 and the second expansion 15' motor/compressor 12' is substantially the same as shown in FIG. 1.

It will thus be seen that the present invention allows efficient supply of compressed air to a living being or other exother microprocessor in a portable hyperbaric chamber.

Certain of the tubes 28 may be deleted. FIGS. 1 and 2 show such tubes as passing gas to and from the intake and exhaust valves of the compressor and expansion motor 12. However, if the appropriate source of gas (pressurized or ambient) is immediately available at the intake or exhaust valves of the expansion motor/compressor, then that tube may be omitted. Thus, the valves 40 and 46 in the embodiments of FIGS. 4, 5, 6*a*, 6*b*, 6*c*, 6*d*, and 8 and 9 and 5 are not connected to tubes. If any of the expansion motor/compressors 12 in these Figures is located within a hyperbaric chamber 10 (similar to the embodiment of FIG. 2), then tubes 28 will be connected to the valves 40 and 46.

The following is a list of the elements and features discussed in my disclosure of my invention and their identifying numbers and labels:

1—gas source or supply (typically the atmosphere)
2—compressed gas source
3—gas sink or receiver (typically the atmosphere)
4—pressure relief valve
6—second expansion motor
8—gas collector (e.g., mask, hood, etc.)
9—drive means (for the motor/compressor 12)
10—hyperbaric chamber
11—access port hole
12—expansion motor/compressor (also 12')
13—heater
14—living creature
15—flame
16—compressor
17—heat exchanger
18—expansion motor
20—containing cylinder
22—spindle
24—compressor displacement volume
26—motor displacement volume
28—tubes
30—end cap on compressor
32—end cap on motor
34—compressor diaphragm
36—motor diaphragm
$R_1$, $R_2$—effective spindle radii
R—radial enlargement on spindle 22
40—compressor intake valve
42—compressor exhaust valve
44—motor intake valve
46—motor exhaust valve
50—spindle motor
52—radially expanded region
54—toroidal portion of a diaphragm
60—vacuum space
62—air spring diaphragm
64—air spring diaphragm
66—air spring tube
68—air spring cavity in spindle 22
70—communicating passage between vacuum space 60 and space 72
72—pressure reducer I do not wish for my invention to be defined or limited by the above description but rather by the following claims.

I claim:

1. Apparatus comprising:

a source of gas, a first quantity of said gas, a first compressor, a flaccid enclosure adapted to contain, a source of exothermally derived heat and an expansion motor, at least a portion of said first quantity of said gas passing in order from said source of gas, through said first compressor, into said enclosure and through said expansion motor, wherein said portion of said first quantity of said gas is compressed in said first compressor, heated by at least a portion of said heat and expanded in said expansion motor.

2. Apparatus as in claim 1 wherein:

said adaptation of said flaccid enclosure allows a person to live within said enclosure.

3. Apparatus as in claim 1 wherein:

said source of said gas is the atmosphere.

4. Apparatus as in claim 1 wherein:

said first compressor comprises at least a first rolling diaphragm and said expansion motor comprises at least a second rolling diaphragm.

5. Apparatus as in claim 1 further comprising a second compressor and a heat exchanger wherein said portion of said first quantity of said gas passes in order from said source of gas, through said second compressor, through said heat exchanger, through said first compressor into said enclosure and through said expansion motor.

6. Apparatus as in claim 1 further comprising a drive means for said first compressor and said expansion motor.

7. The method of promoting an exothermic oxidizing process within a flaccid walled enclosure wherein:

low pressure air is successively compressed to a higher pressure which pressure is adequate to promote said exothermic oxidation process, heated by heat produced by the said exothermic oxidation process and expanded wherein the work to compress said air is provided by the work produced by said expansion.

8. Apparatus as in claim 1 wherein said source of exothermally derived heat is associated with oxidation of fuel in a flame.

9. Apparatus as in claim 8 wherein said flame is used to heat a consumable contained within a vessel.

10. Apparatus as in claim 1 wherein said portion of said first quantity of said gas is collected by a collector after it is heated by said said source of exothermally derived heat and before said portion of said first quantity of said gas is expanded in said expansion motor.

11. A method as in claim 8 wherein:

said exothermal oxidizing process is a metabolic process performed by a living being.

12. Hyperbaric chamber apparatus comprising:

a flaccid wall container adapted to contain gas at an increased pressure and further adapted to contain gas at an increased temperature, means for using work to compress a quantity of gas, means for conveying said quantity of compressed gas into said container, means for conveying said quantity of compressed gas from the interior of said container to means for producing said quantity of work by expanding said quantity of gas wherein said container is adapted and sized to contain a source of heat.

13. Hyperbaric chamber apparatus comprising:

a flaccid wall container adapted to contain gas at an increased pressure and further adapted to contain gas at an increased temperature, means for using work to compress a quantity of gas, means for conveying said quantity of compressed gas into said container, means for conveying said quantity of compressed gas from the interior of said container to means for producing said quantity of work by expanding said quantity of gas wherein said container is adapted and sized to contain a person.

14. Hyperbaric chamber apparatus comprising:

a flaccid wall container adapted to contain gas at an increased pressure and further adapted to contain gas at an increased temperature, means for using work to compress a quantity of gas, means for conveying said quantity of compressed gas into said container, means for conveying said quantity of compressed gas from the interior of said container to means for producing said quantity of work by expanding said quantity of gas wherein said container is adapted and sized to contain a flame.

15. A method of compressing gas for supply to a hyperbaric chamber containing a pressurized gas which hyperbaric chamber is adapted to allow a person to live within the hyperbaric chamber comprising the steps of:

adding heat to the pressurized gas in said hyperbaric chamber, taking a first quantity of pressurized gas from within said hyperbaric chamber, expanding said first quantity of pressurized gas and using the work produced by the expansion of said first quantity of gas to effect compression of a second quantity of gas, compressing a second quantity of gas whereby said second quantity of gas is compressed using said work to effect said compression, and adding said second quantity of now compressed gas into the pressurized gas within said hyperbaric chamber.

* * * * *